United States Patent [19]

Murai

[11] Patent Number: 4,744,222

[45] Date of Patent: May 17, 1988

[54] VERY LOW TEMPERATURE LIQUID TRANSFER SYSTEM

[75] Inventor: Takashi Murai, Kobe, Japan

[73] Assignee: Mitsubishi Denki Kabushiki Kaisha, Tokyo, Japan

[21] Appl. No.: 13,553

[22] Filed: Feb. 11, 1987

[30] Foreign Application Priority Data

Feb. 27, 1986 [JP] Japan ..... 61-42981

[51] Int. Cl.[4] ..... F17C 13/02

[52] U.S. Cl. ..... 62/49; 62/55

[58] Field of Search ..... 62/49, 55

[56] References Cited

U.S. PATENT DOCUMENTS

| | | | |
|---|---|---|---|
| 3,262,280 | 7/1966 | Chaney | 62/49 |
| 3,430,450 | 3/1969 | Bogner et al. | 62/55 |
| 3,442,091 | 5/1969 | Klipping et al. | 62/55 |
| 3,845,636 | 11/1974 | Van Mal et al. | 62/55 |

*Primary Examiner*—Ronald C. Capossela

*Attorney, Agent, or Firm*—Oblon, Fisher, Spivak, McClelland & Maier

[57] ABSTRACT

A very low temperature liquid transfer system of the present invention is constructed with first and second containers, each storing therein very low temperature liquid; a connecting tube for communicatively connecting the first and second containers; a pressure control system for increasing and decreasing a pressure in the first container for pressurized transfer of the very low temperature liquid from the first container into the second container through the connecting tube; a pressure gauge for measuring a pressure in the first container; a liquid level sensor for measuring a quantity of the very low temperature liquid in the second container; and a control which functions to logically determine input signals from the pressure gauge and the liquid level sensor, and to produce an output operating signal to the pressure control system based on the logical determination.

7 Claims, 3 Drawing Sheets

VERY LOW TEMPERATURE LIQUID TRANSFER SYSTEM

BACKGROUND OF THE INVENTION

1. Field of the Invention

This invention relates to a system for transferring very low temperature (cryogenic) liquid such as liquefied helium, liquefied nitrogen, and so forth from one container to another.

2. Discussion of Background

FIG. 5 of the accompanying drawing schematically illustrates a conventional very low temperature liquid transfer system as described, for example, in "MONOGRAPHS ON THE PHYSICS AND CHEMISTRY OF MATERIALS (Experimental Techniques in Low Temperature Physics, Storage and Transfer of Liquefied Gases, p.50, Oxford University Press, 1959)".

In the Drawing, a reference numeral 1 designates a very low temperature liquid such as liquefied helium, liquefied nitrogen, etc.; a numeral 2 refers to a first container to store therein the very low temperature liquid 1; a reference numeral 3 denotes a second container which is communicatively connected with the first container 2 through a connecting means 4 constituted by a transfer tube, and which stores therein the very low temperature liquid 1 to be transferred from the first container 2 by way of the transfer tube 4; a reference numeral 5 represents a liquid level sensor for measuring quantity of the very low temperature liquid 1 in the second container 3; and a reference numeral 6 designates a pressure control system which controls increase and decrease in the pressure within the first container 2 for the pressurized transfer of the very low temperature liquid 1 in the first container 2 to the second container 3 by way of the transfer tube 4, the pressure control system 6 in this drawing being constructed, as one example, with a pressurized gas source 7 for increasing pressure within the first container 2, a pressure reducing valve 8 for the pressurized gas, a pressure gauge 9 for detecting a pressure of the depressurized gas and a three-way electromagnetic valve 10 for increasing and decreasing pressure within the first container 2. A reference numeral 11 designates a control circuit which makes logical determination on an input signal from the liquid level sensor 5, and produces an output operating signal to the three-way electromagnetic valve 10, and a numeral 12 refers to a gas discharge port for discharging evaporated gas of the very low temperature liquid 1 in the second container 3 into the external atmosphere.

In the following, explanations will be given as to the operations of this very low temperature liquid transfer system. The quantity of the very low temperature (or cryogenic) liquid stored in the second container 3 is constantly monitored by the liquid level sensor 5 and the control circuit 11. When the quantity of the very low temperature liquid 1 in the second container 3 goes down below the lower limit value thereof, the liquid level sensor 5 denotes the quantity, and the control circuit 11 produces an output operating signal to start transfer of the liquid. With this operating signal, the three-way electromagnetic valve 10 begins to work, whereby the pressurized gas, which has come out of the pressurized gas source 7 and has been adjusted its pressure by means of the pressure-reducing valve 8 and the pressure gauge 9, is fed into the first container 2 by way of the three-way electromagnetic valve 10. By the pressure difference between the pressure in the first container 2 and the pressure in the second container 3, the very low temperature liquid 1 in the first container 2 is transferred into the second container 2 through the transfer tube 4. When the quantity of the very low temperature liquid 1 transferred into the second container 3 reaches the upper limit value thereof, the liquid level sensor 5 detects the liquid quantity and the control circuit 11 produces an output operating signal for stoppage of the liquid transfer. With this operating signal, the three-way electromagnetic valve 10 beings to operate to stop feeding of the pressurized gas from the pressurized gas source 7 into the first container 2, and, at the same time, to let the gas within the first container 2 out into the external atomosphere to offset a difference in pressure between the first container 2 and the second container 3, whereby the transfer of the very low temperature liquid 1 into the second container 3 is stopped. Incidentally, the discharge port 12 is provided in the second container 3, through which evaporated gas of the very low temperature liquid 1 is constantly discharged.

Since the conventional automatic transfer system of the very low temperature liquid is constructed as described above, it still requires monitoring by a human being outside the system, while it is being operated automatically, so as to prevent various abnormal situations from taking place, such as excessive rise in the pressure due to certain causes which are liable to bring about damage in the container; back-flow of evaporated gas in the second container 3 into the very low temperature liquid 1 within the first container 2 due to reversal of the pressure difference between the first container 2 and the second container 3; rise in the temperature within the second container 3 and increase in the evaporating speed of the very low temperature liquid in the second container 3 due to exhaustion of the very low temperature 1 in the first container 2 and direct feeding of the pressurized gas at a room temperature into the second container 3; and others

SUMMARY OF THE INVENTION

The present invention has been made with a view to solving the points of problems as mentioned above, and aims at providing a very low temperature liquid transfer system which is not only capable of transferring ordinary very low temperature liquid, but also capable of safely performing the protective operation even at the occurrence of abnormality in the system.

It is therefore an object of the present invention to provide a very low temperature liquid transfer system equipped with a pressure gauge for measuring a pressure in the first container, and a control circuit for carrying out logical determination of input signals from this pressure gauge and a liquid level sensor for measuring quantity of the very low temperature liquid in the second container, and producing output operating signal to a pressure control system.

According to the present invention, in-general aspect of it, there is provided a very low temperature liquid transfer system, which comprises in combination: first and second containers, each storing therein very low temperature liquid; connecting means for communicatively connecting said first and second containers; a pressure control system for increasing and decreasing a pressure in said first container for pressurized transfer of the very low temperature liquid from said first container into said second container through said connecting means; a pressure gauge for measuring a pressure in said first container; a liquid level sensor for measuring a quantity of said very low temperature liquid in said second contaier; and a control circuit which functions to logically determine input signals from said pressure gauge and said liquid level sensor, and to produce an output operating signal to said pressure control system based on the logical determination.

In the very low temperature liquid transfer system according to the present invention, the control circuit makes the logical determination of input signals from the liquid level sensor and the pressure gauge, and produces an output operatiung signal to the pressure control system, whereby the transfer and stoppage of the very low temperature liquid from the first container to the second container are carried out.

The foregoing object, other objects as well as specific construction and operation of the very low temperature liquid transfer system according to the present invention will become more apparent and understandable from the following detailed description thereof, when read in conjunction with the accompanying drawing.

BRIEF DESCRIPTION OF THE ACCOMPANYING DRAWING

DETAILED DESCRIPTION OF PREFERRED EMBODIMETNS

Figure 1:
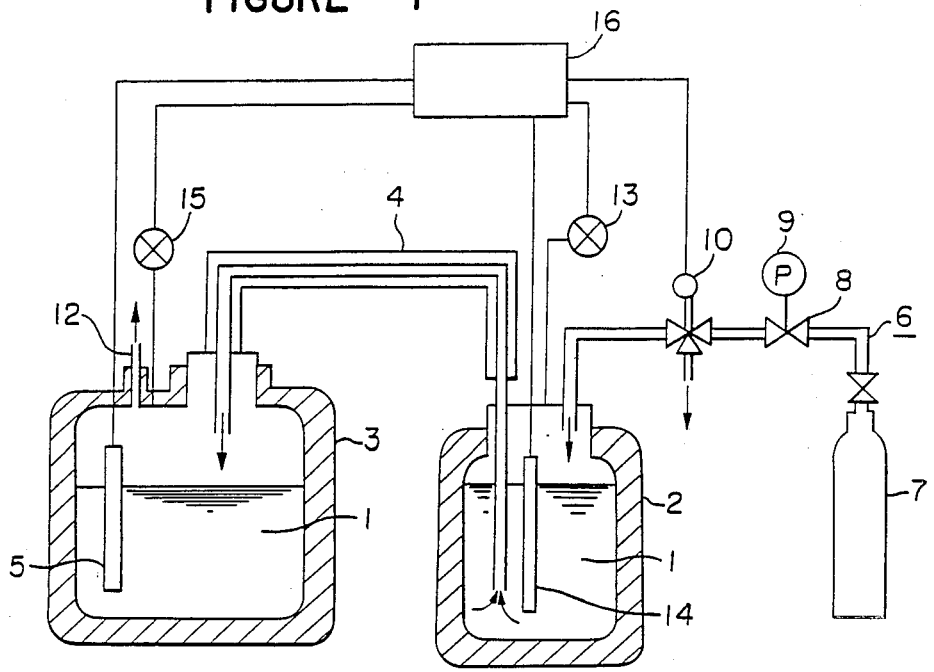
FIG. 1 is a system diagram of the very low temperature liquid transfer system accodrding to one embodiment of the present invention.

In the following, one preferred embodiment of the present invention will be explained in reference to FIG. 1. In the drawing, reference numerals 1 through 10 and 12 designate the identical parts as in the above-described conventional very low temperature liquid transfer system. A reference numeral 13 designates a pressure gauge for measuring a pressure in the first container 2; a reference numeral 14 designates a liquid level sensor provided in, for example, the first container 2 and for measuring the quantity of the very low temperature liquid therein; a reference numeral 15 denotes a pressure gauge provided in, for example, the second container 3 for measuring the pressure in the second container 3; and a reference numeral 16 represents a control circuit for making the logical determination of the input signals from, for example, each of the liquid level sensors 5, 14 and each of the pressure gauges 13, 15, and producing an output operating signal to the three-way electromagnetic valve 10 of the pressure control system 6.

In the following, explanations will be made as to the operations of the very low temperature liquid transfer system of the present invention. It is to be noted that the ordinary transfer operations of the very low temperature liquid is the same as in the conventional system. Same as the liquid level sensor 5 in the conventional liquid transfer system, each of the pressure gauges 13, 15 and the liquid level sensor 14, in combination with the control circuit 16, constantly monitors each state of the pressure and the liquid quantity. During the transfer of the very low temperature liquid, when the pressure in the first container 2 exceeds the upper limit value, an output operating signal for stoppage of the supply is produced from the control circuit 16, and the three-way electromagnetic valve 10 stop pressurization of the first container 2 and to discharge the pressurizing gas outside the system. In the course of these operations, the transfer of the very low temperature liquid 1 is continued. When the pressure within the first container 2 reaches its lower limit value, an output operating signal for starting the liquid transfer is again produced from the control circuit 16 to resume pressurization of the interior of the first container 2. Also, even when the pressure in the second container 3 exceeds the upper limit value during the transfer of the very low temperature liquid, the three-way electromagnetic valve 10 is operated in the same manner as in the case of excessive pressurization of the first container 2, and functions to continue transfer of the very low temperature liquid, while adequately adjusting the pressure in the second container 3.

When the quantity of the very low temperature liquid 1 within the first container 2 goes down below the lower limit value, an output operating signal for stoppage of the liquid trnafer is produced from the control circuit 16 to thereby stop the transfer operation of the very low temperature liquid. Moreover, reversal of the pressure difference in the first container 2 and the second container 3 can be prevented by adjustment of the upper and lower limit value of the pressure gauges 13 and 15. These protective operations is preferentially executed to the ordinary operations, whereby the very low temperature liquid can be transferred safely and automatically without bringing about damage to the devices of the system and secondary troubles and disorders owing to those various abnormalities as described in the foregoing.

Figure 2:
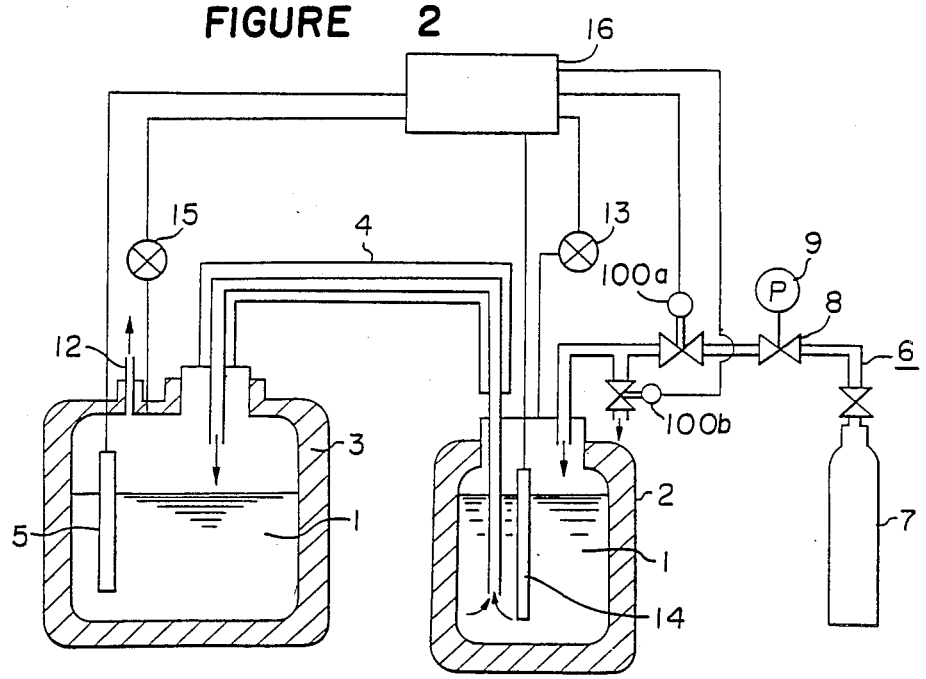
FIGS. 2, 3 and 4 are respectively system diagrams showing the very low temperature liquid transfer systems according to other embodiments of the present invention.

Although in the above-described embodiment of the present invention, explanations have been made as to a case, wherein the three-way electromagnetic valve 10 is provided in the pressure control system 6 provided in the first contaier 2. It is however possible that, as shown in FIG. 2, two units of two-way electromagnetic valve **100*a* and 100*b* are provided in place of the signal unit of the three-way electromagnetic valve, each being made to operate in accordance with an output operating signal from the control circuit 16**, whereby the same effect as in the above-described embodiment can be attained.

Figure 3:
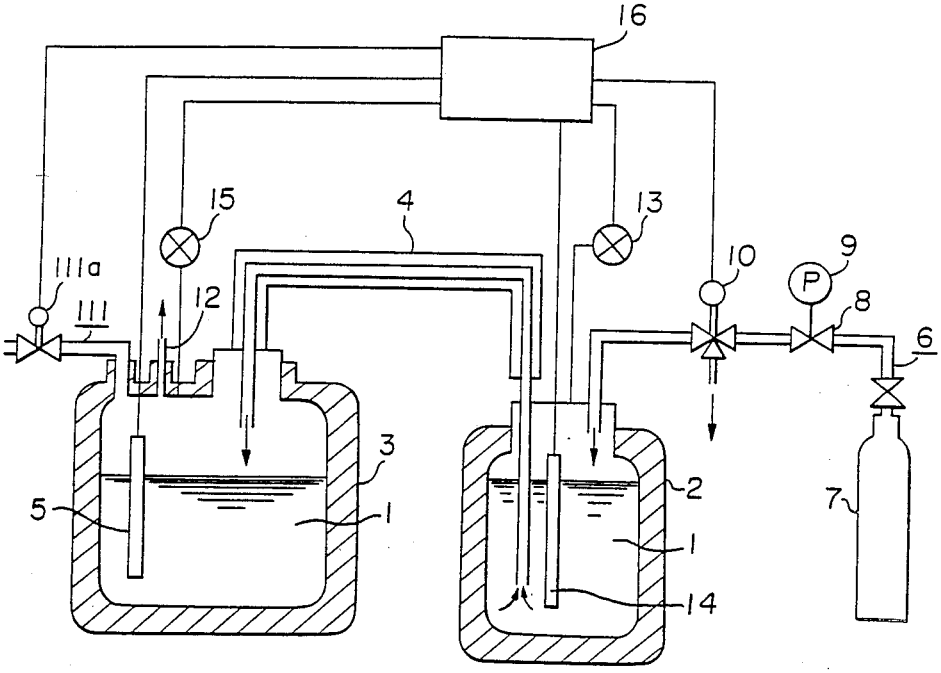
Figure 4:
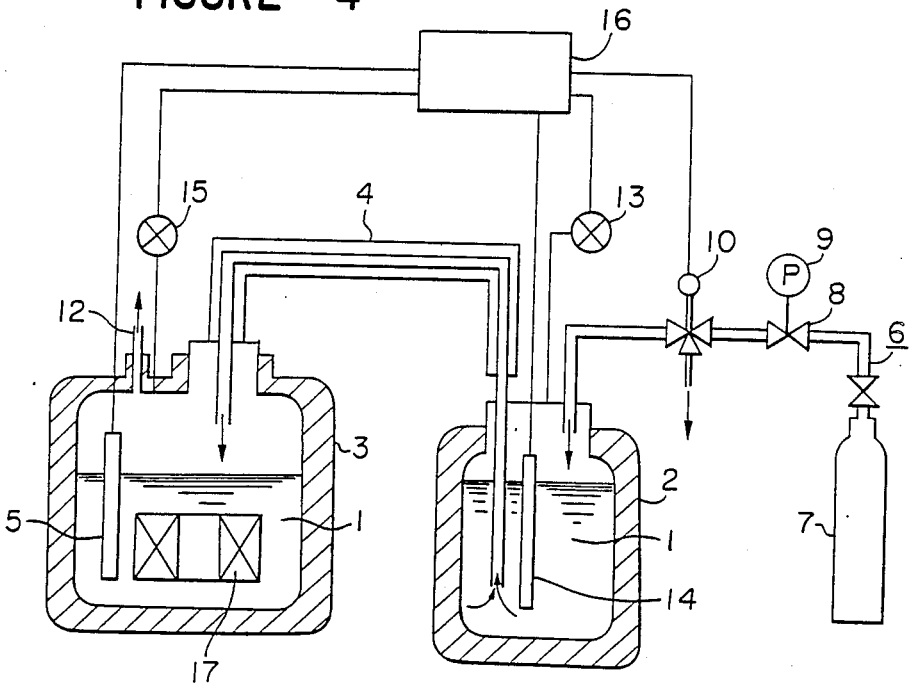
Figure 5:
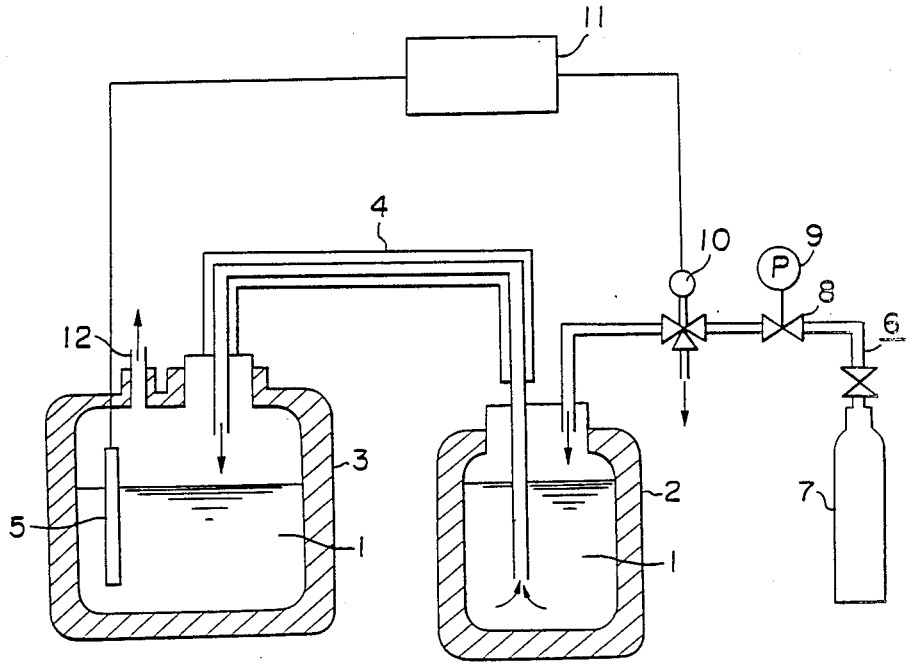
FIG. 5 is a system diagram showing a conventional very low temperature liquid transfer system.

Furthermore, when a permissible pressure limit value of the second container 3 with respect to the upper limit value of the pressure has a small margin, hence it is necessary to quickly escape from an excessive pressure state, a by-pass discharge system 111 having a two-way electromagnetic valve **111*a* may be provided in the second container 3, besides the discharge port 12, as shown in FIG. 3, which may be opened and closed by an output operating signal produced from the control circuit 16. In the above-described embodiments, explanations have been made as to a simple transfer system of the very low temperature liquid from one container to another. It should, however, be understood that the present invention is also applicable to a very low temperature liquid transfer system as the so-called "superconducting appliance", in which a superconducting coil 17 is immersed in the very low temperature liquid 1 in the second container 3, as shown in FIG. 4**.

Furthermore, in the above-described embodiments, explanations have been made as to the cases, wherein the first container 2 is provided with the liquid level sensor 14, and the second container 3 is provided with the pressure gauge 15. It should, however, be noted that these devices may be provided depending on necessity, and that the intended purpose can only be attained, if and when the liquid level sensor 5 for maesuring the liquid quantity of the very low temperature liquid in the second container 3 and the pressure gauge 13 for measuring the pressure within the first container 2 are provided.

As has been described in the foregoing, the present invention is so constructed that the pressure in the first container is measured by the pressure gauge; the quantity of the very low temperature liquid in the second container is measured by the liquid level sensor; input signals from the pressure gauges and the liquid level sensors are determined logically by the control circuit, based on which determination an output operating signal is produced from the control circuit to the pressure control system for increasing and decreasing the pressure within the first container, and with which operating signal the pressure control system beings its operation to transfer the very low temperature liquid from the first container to the second container, or to stop such liquid transfer. On account of this, there may be realized the very low temperature liquid transfer system which is capable of transferring ordinary very low temperature liquid from one container to another, or stopping such liquid transfer, and, at the same time, even when abnormal situation happens, the protective operations of the system can be carried out safely.

So far the present invention has been described with particular reference to the preferred embodiments of the very low temperature liquid transfer system according to the present invention. It should, however, be understood that the invention is not limited to these embodiments only, but any changes and modifications may be made by those persons skilled in the art within the ambit of the present invention as recited in the appended claims.

What is claimed is:

1. A very low temperature liquid transfer system, which comprises in combination:

(a) first and second containers, each storing therein very low temperature liquid;

(b) connecting means for communicatively connecting said first and second containers;

(c) a pressure control system for increasing and decreasing a pressure in said first container for pressurized transfer of the very low temperature liquid from said first container into said second container through said connecting means and for controlling the pressure in said second container;

(d) a pressure gauge for measuring the pressure in said first container;

(e) a liquid level sensor for measuring a quantity of said very low temperature liquid in said second container; and (f) a control circuit which functions to logically determine input signals from said pressure gauge and said liquid level sensor, and to produce an output operating signal to said pressure control system based on the logical determination.

2. A very low temperature liquid transfer system according to claim 1, wherein said first container is provided with the liquid level sensor for measuring the quantity of the very low temperature liquid in said first container, and a signal from said level sensor is logically determined by said control circuit.

3. A very low temperature liquid transfer system according to claim 1 or 2, wherein said second container is provided with the pressure gauge, and a signal from said pressure gauge is logically determined by said control circuit.

4. A very low temperature liquid transfer system according to claim 3, wherein said second container stores therein a superconducting coil.

5. A very low temperature liquid transfer system according to claim 4, wherein said pressure control system controls increase and decrease in the pressure by means of a three-way electromagnetic valve.

6. A very low temperature liquid transfer system according to claim 4, wherein said pressure control system controls increase and decrease in the pressure by means of two units of two-way electromagnetic valve.

7. A very low temperature liquid transfer system according to claim 6, wherein said second container is provided with a by-pass discharge system having a two-way electromagnetic valve which operates with an output signal from the control circuit.

* * * * *